United States Patent [19]

Habinak

[11] Patent Number: 5,077,645

[45] Date of Patent: Dec. 31, 1991

[54] LOW VOLTAGE HALOGEN LIGHTING FIXTURE

[76] Inventor: Gerald J. Habinak, 975 Whigam Rd., Riverwoods, Ill. 60015

[21] Appl. No.: 700,597

[22] Filed: May 15, 1991

[51] Int. Cl.[5] ..... H01R 33/00

[52] U.S. Cl. ..... 362/226; 362/265; 362/276; 362/287; 362/419

[58] Field of Search ..... 362/287, 226, 263, 265, 362/269, 282, 285, 276, 372, 419, 802, 427

[56] References Cited

U.S. PATENT DOCUMENTS 3,366,784 1/1968 Hilzen ..... 362/265

4,459,648 7/1984 Ullman ..... 362/226 X 4,639,843 1/1987 Compton ..... 362/226 X

*Primary Examiner*—Stephen F. Husar

*Attorney, Agent, or Firm*—Rockey and Rifkin

[57] ABSTRACT

A low voltage halogen lighting fixture includes a threaded base portion adapted to engage a standard light socket and a step down transformer. A bracket supports a low voltage halogen lamp for rotational and pivotal movement and the threaded portion is ratcheted to allow full rotation of the entire fixture. A thermocouple shuts down lamp operation if a predetermined operating temperature is exceeded and automatically restores power when the temperature returns to the safe region.

7 Claims, 1 Drawing Sheet

LOW VOLTAGE HALOGEN LIGHTING FIXTURE

BACKGROUND AND OBJECTS OF THE INVENTION

The present invention relates generally to an improved lighting fixture and, more particularly to a low voltage halogen lamp adapted for use as a replacement for standard light bulbs.

Halogen lighting is gaining prominence for lighting in retail store displays. Halogen lights are brighter and whiter than light produced by standard light bulbs. Many retailers have converted their standard sales area fixturing from standard incandescent lighting to 110 volt a.c., 90 watt halogen light bulbs.

Alternatively, some stores desire to renovate their display lighting capability by installing systems of low voltage halogen lights. Such lamps (for example a 12 volt a.c., 50 watt MR16 bulb) produce approximately the same lumen output as higher voltage 90 watt halogen lamps or standard 150 watt incandescent light bulbs. As indicated, low voltage halogen bulbs operate using considerably less power than either higher voltage halogen bulbs or standard incandescent bulbs providing a meaningful cost savings.

However, such renovations are costly and time consuming. The disarray created in the sales areas causes customer dissatisfaction. A retrofit lighting fixture that may be easily substituted for a standard incandescent light bulb is desirable.

Accordingly, it is an object of the present invention to provide an improved low voltage halogen lighting fixture.

It is another object of the invention to provide such a lighting fixture that may be substituted for a standard incandescent lighting fixture.

It is a further object of the invention to provide such a lighting fixture having durable construction at a low cost.

It is yet another object of the invention to provide such a device capable of positioning a lighting source in any desired orientation.

These and other objects of the invention will become apparent to those skilled in the art when the following detailed description of the invention is read in conjunction with the accompanying drawings.

SUMMARY OF THE INVENTION

The present invention is a low voltage halogen lighting fixture adapted to be substituted for a standard incandescent light bulb. The fixture includes a threaded base portion adapted to engage a standard light socket and a transformer to step down standard 110 volt a.c., 60 hertz power to a level usable by an integral low voltage halogen lamp. The lamp is mounted for pivotal movement on a bracket secured to the transformer and the threaded portion is ratcheted to allow 360° rotation of the entire fixture. Thus, the lamp may be positioned in any desired orientation. The fixture also includes a thermocouple for shutting down the lamp if a predetermined operating temperature is exceeded and automatically turning the lamp back on when the temperature returns to the safe region.

DETAILED DESCRIPTION OF A PREFERRED EMBODIMENT

Figure 1:
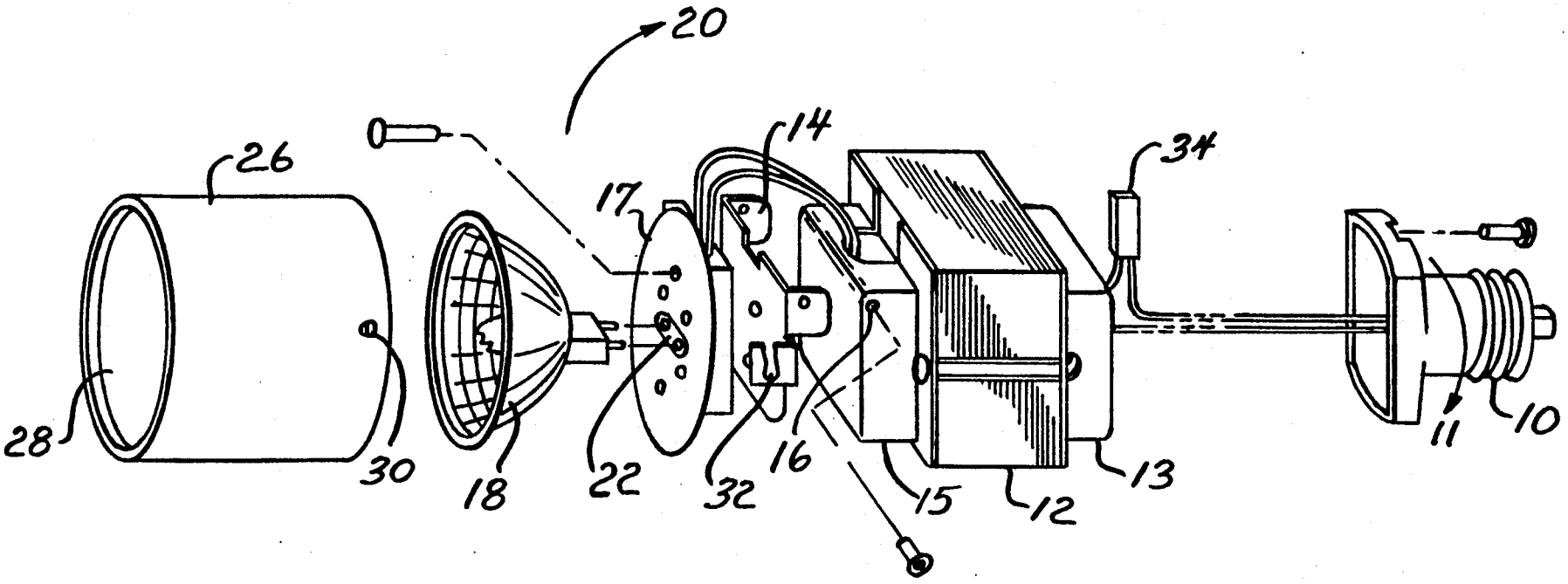
FIG. 1 is an exploded view of the lighting fixture of the present invention.

Referring to the drawing, FIG. 1 shows an exploded view of the lighting fixture of the present invention. A threaded base portion 10 of the type commonly known in the art (for example, a #16 ratcheted plug base phenolic adapter manufactured by Triboro Electric Corporation) allows the fixture to be disposed in a standard incandescent lighting socket. Because the threaded base 10 is ratcheted, the fixture of the present invention is capable of 360° rotation in the direction shown by arrow 11.

A transformer 12 is fitted with a pair of metal end bells 13, 15. The base 10 is riveted to the end bell 13. Electrical connections are provided between the threaded portion of the base 10 and the primary side of the transformer 12. The transformer 12 steps down standard electrical power to a level suitable to the operation of a low voltage halogen bulb, for example, 12 volt a.c., 50 va. Although a wire wound core transformer is used in the preferred embodiment, it is contemplated that the transformer could be replaced with any means for reducing standard 110 volt a.c., 60 hertz electric power to a level suitable for operation of low voltage halogen lamps.

A bracket 14 is riveted to the end bell 15 for pivotal motion about an axis 16. The bracket 14 includes a reflector plate 17 and a socket 22, which is adapted to receive a low-voltage halogen lamp 18. The combination reflector plate 17 and socket 22 is of the type commonly known in the art, for example, part no. 422-15 manufactured by Triboro Electric Corporation. The socket 22 is electrically connected to the secondary windings of the transformer 12 via a pair of wires 24. Thus, the lamp 18 is powered from the secondary windings of the transformer 12. A shroud 26 having a lens 28 is removably mounted to the bracket 14, as will be fully described hereinafter, to protect the lamp 18 and to facilitate easy replacement.

The construction of the fixture of the present invention allows the user to position the lamp in virtually any orientation desired. As previously noted, the bracket 14 allows pivotal motion at the lamp 18 about axis 16 in the direction shown by arrow 20. The threaded portion of the base 10 is ratcheted to allow rotation of 360° in the direction shown by arrow 11. These features allow the user to position the lamp in any desired orientation.

Furthermore, the construction of the present invention allows easy replacement of the lamp 18 when it burns out. The shroud 26 is formed to include a pair of diametrically opposed posts 30 extending inwardly. The posts 30 are adapted to cooperate with a pair of slots 32 on the bracket 14. The shroud 26 is installed by slipping it over the lamp 18 and twisting it, causing the posts 30 to engage the slots 32. To replace the lamp 18, this process is reversed, allowing the burned out lamp to be removed from the socket 22 and replaced with a new one. The shroud is then reinstalled. Thus, the lamp 18 may be replaced without removing the entire fixture from its socket.

Another feature of the present invention is on-board over-temperature protection. A thermocouple of the type commonly known in the art is installed in series with the electrical connection between the base 10 and the transformer 12. If the operating temperature of the fixture reaches a predetermined threshold level (for example, 180° C.), the thermocouple 34 operates to break the electrical circuit, causing the lamp 18 to turn off. When the temperature returns to a safe level, the thermocouple operates to complete the circuit, allowing the lamp 18 to turn back on.

The present invention has been described with respect to certain embodiments, which are not meant to limit the invention. Those skilled in the art will understand that variations from the embodiments and conditions described herein may be made without departing from the invention as set forth in the appended claims.

What is claimed is:

1. A lighting fixture to replace existing incandescent lighting with halogen lamps, comprising:

a) a base having a threaded portion adapted to cooperate with a standard incandescent lighting socket;

b) a means for reducing standard 110 volt a.c., 60 cycle power to a level suitable for operation of a low voltage halogen lamp, said reducing means being electrically connected to said base, and;

c) a halogen lamp socket connected to said reducing means adapted to receive a halogen lamp to be powered by said reducing means d) means for mounting said fixture for rotational movement in a standard lighting socket e) means for mounting said halogen lamp socket for pivotal movement relative to said fixture whereby a standard light bulb can be replaced in existing fixtures with more efficient and economical halogen lamps.

2. The lighting fixture of claim 1 wherein said means for reducing comprises a transformer having a primary coil electrically connected with said base and a secondary coil electrically connected with said socket.

3. The lighting fixture of claim 1 further comprising a halogen lamp mounted in said socket.

4. The lighting fixture of claim 1, further comprising means for preventing operation of said lamp if the operating temperature of said fixture exceeds a predetermined maximum temperature and resuming operation of said lamp when the operating temperature drops below a second predetermined temperature.

5. The lighting fixture of claim 1, further comprising a shroud for said halogen lamp.

6. The lighting fixture of claim 5 wherein said shroud is cylindrical in shape.

7. The lighting fixture of claim 1 further comprising a cylindrical shroud for said halogen lamp, said shroud including a pair of diametrically opposed posts extending inwardly thereinto, said means for mounting for pivotal motion including a pair of slots adapted to receive said posts to secure said shroud to said fixture.

* * * * *